United States Patent [19]

Reimbert

[11] 4,444,338

[45] Apr. 24, 1984

[54] VESSEL FOR THE STORAGE OF POWDERED OR GRANULAR PRODUCTS

[76] Inventor: André Reimbert, 67, Boulevard de Reuilly F-75012 Paris, France

[21] Appl. No.: 294,744

[22] Filed: Aug. 20, 1981

[30] Foreign Application Priority Data

Sep. 4, 1980 [FR] France ..... 80 19097

[51] Int. Cl.[3] ..... B65D 88/54; B65G 65/46

[52] U.S. Cl. ..... 222/149; 222/228; 222/236; 222/405; 222/464; 15/246.5; 414/319

[58] Field of Search ..... 222/405, 464, 547, 564, 222/148, 149; 414/297, 319, 324

[56] References Cited

U.S. PATENT DOCUMENTS

| | | | |
|---|---|---|---|
| 670,581 | 3/1901 | Erisman | 222/405 |
| 2,500,043 | 3/1950 | Radtke | 222/405 X |
| 2,615,594 | 10/1952 | Clapp | 222/405 X |
| 3,341,090 | 9/1967 | Reimbert | 222/464 |
| 3,710,960 | 1/1973 | Stauffer et al. | 414/324 |
| 3,794,190 | 2/1974 | Lambert | 414/297 X |
| 3,809,293 | 5/1974 | Chappell | 222/148 |

*Primary Examiner*—Joseph J. Rolla
*Assistant Examiner*—Frederick R. Handren
*Attorney, Agent, or Firm*—Young & Thompson

[57] ABSTRACT

A vertical discharge duct provided on a storage vessel wall terminates either in a separate duct outlet or in the vessel outlet at the lower end of the discharge hopper. A duct-clearing carriage is displaceable vertically along the entire length of the duct and the lower end of the duct has an extension which serves as a housing for the carriage when it is not in use. The carriage is equipped with a rotary device for disaggregating the stored material in order to clear the duct in the event of clogging. Disaggregating devices can also be installed within the vessel and within the discharge hopper.

12 Claims, 10 Drawing Figures

VESSEL FOR THE STORAGE OF POWDERED OR GRANULAR PRODUCTS

This invention relates to vessels used for the storage of powdered or granular products.

One of the problems arising from the storage of products of this type lies in the difficulties encountered in some instances when discharging them from storage vessels. In fact, some of these products very frequently collect into a caked mass, thus making it impossible to discharge them by simple gravity flow. One expedient which has already been proposed in order to overcome this difficulty consists in placing a mechanical extraction device in the bottom portion of a storage vessel of this type, the function of the device being to collect materials located at the periphery and to transfer them to the central discharge outlet. This solution, however, is attended by a certain number of disadvantages. The most important disadvantage lies in the fact that, since the discharge operation is thus performed by withdrawal of material from the periphery, the mass of stored material is set in motion in an eccentric manner, thus in turn producing dangerous overpressures on the vessel walls.

It has also been proposed to improve the discharge of products of this type by providing a vertical discharge duct which extends to the full height of the inner wall and terminates in an additional discharge outlet. This duct accordingly communicates with the interior of the corresponding vessel only via one or a number of openings located at intervals from the bottom to the top end of the duct. The discharge operation may thus be carried out by starting with the upper layers, the result thereby achieved being to facilitate emptying of the vessel and to prevent dangerous overpressures on the vessel walls.

However, this solution does not prove wholly satisfactory since the products being discharged tend to agglomerate within the vertical discharge duct, thus interrupting the flow process. Moreover, similar phenomena are liable to arise within the interior of the storage vessel itself and this also prevents any possibility of discharge simply under the action of gravity.

For the reason just given, the aim of the present invention is to overcome the difficulties explained in the foregoing and to make it possible to discharge powdered or granular products even when these latter are subject to a high potential danger of cohesion.

To this end, the invention relates to a storage vessel provided on the vessel wall with a vertical discharge duct of the type recalled earlier. Provision is made within said discharge duct for a duct-clearing carriage equipped with a rotary device for causing disaggregation of the stored material. Said carriage is mounted so as to be capable of displacement over a distance corresponding to the full height of said duct, an extension being provided at the lower end of the duct in order to constitute a housing for said carriage in the position in which it is not in use.

Thus in the event of clogging of the vertical discharge duct, the duct can be cleared by displacing the carriage which is provided for this purpose.

In one embodiment of a vessel for storage and discharge of materials which present a very high potential danger of agglomeration of agglutination, provision is additionally made for a movable disaggregating unit which can be displaced within the storage vessel itself over a range of travel corresponding to the full height of the vessel. Said disaggregating unit is equipped with one or a number of mechanical extraction elements which terminate within the vertical discharge duct, provision being made above said elements for a rotary disaggregating member such as a vertical rotating shaft. The upper end of said vertical shaft is adapted to carry one or a number of chains for striking and thus disaggregating the stored material.

Thus, in the event of agglomeration or caking of the particles of stored material, said unit can be moved downwards within the storage vessel to the level at which said agglomeration has taken place.

Moreover, provision can also be made for another disaggregating unit which is stationarily fixed within the interior of the bottom hopper in order to forestall any danger of agglomeration within this latter.

Other features and advantages of storage vessels in accordance with the invention will become apparent upon consideration of the following description and accompanying drawings, wherein.

Figure 1:
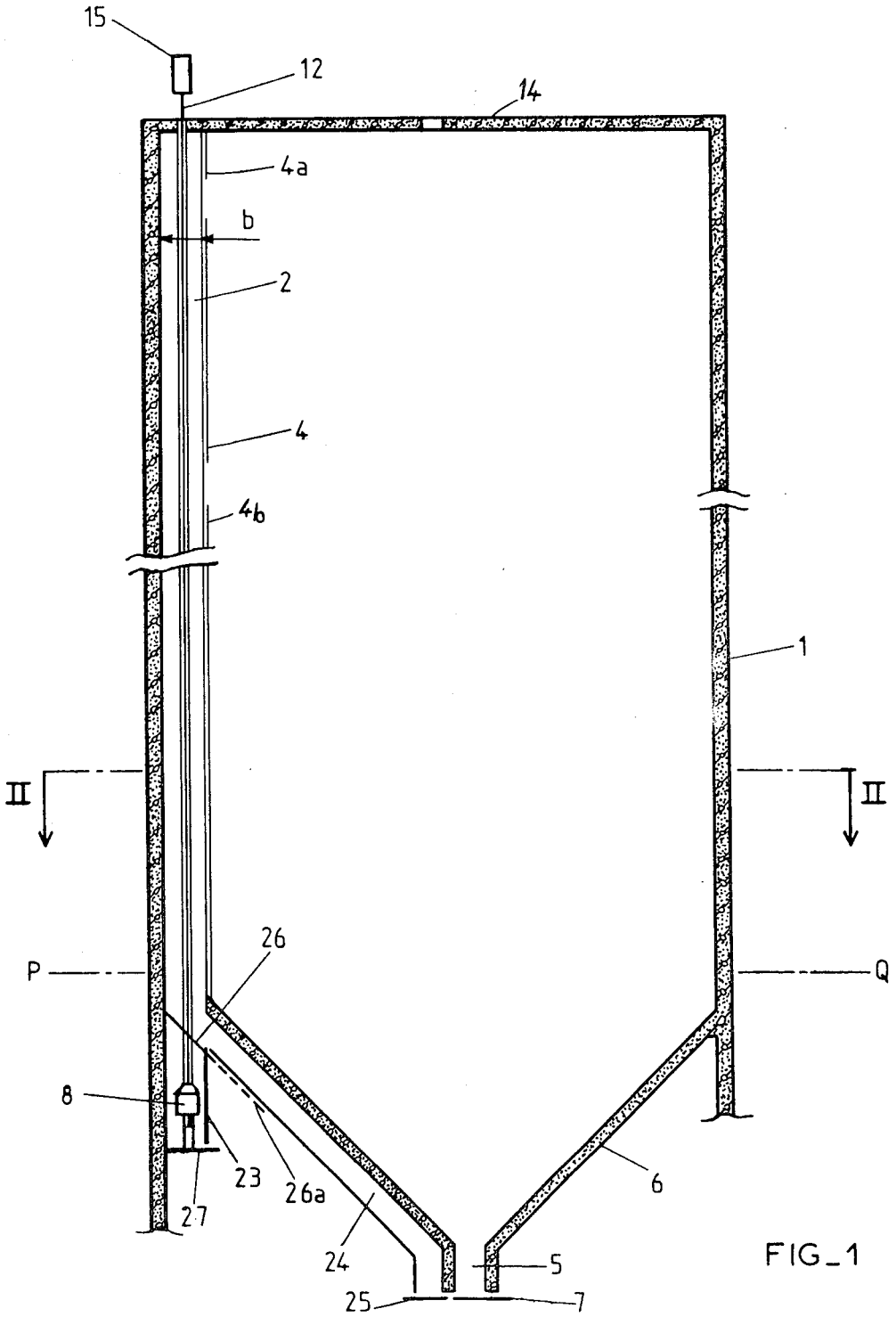
FIG. 1 is a vertical diametral sectional view of a storage vessel in accordance with the invention.
Figure 2:
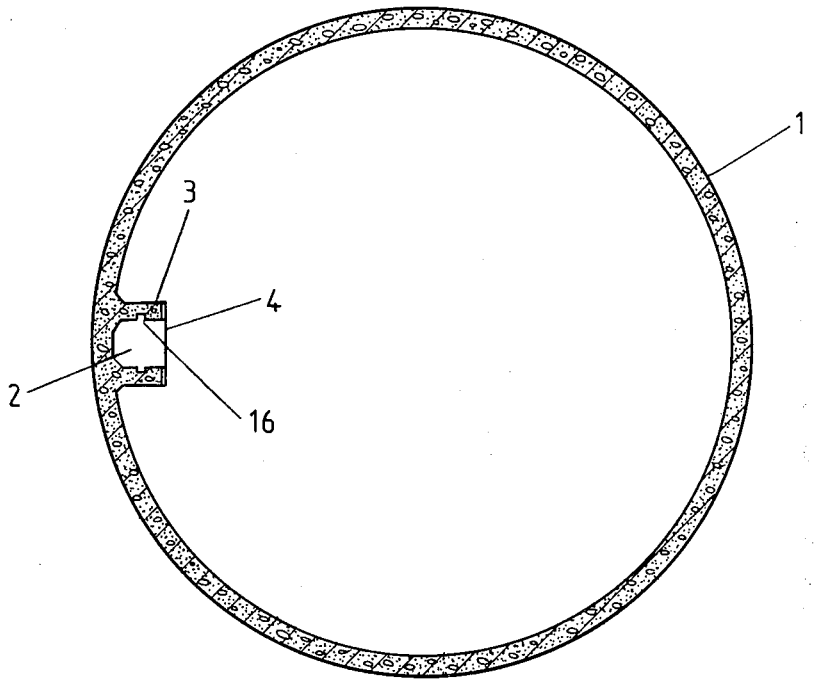
FIG. 2 is a horizontal sectional view taken along line II—II of FIG. 1.

The storage vessel 1 illustrated in FIGS. 1 and 2 assumes a cylindrical shape. However, the vessel could have any other suitable shape and is constructed of reinforced concrete or of any other suitable material.

A vertical discharge duct 2 is provided on the internal wall of said vessel and extends over a distance corresponding to the full height of this latter. In the example shown, said duct is formed by two short vertical walls 3 having a relative spacing a which therefore corresponds to the width of said duct whist the depth of this latter is determined by the width b of said two short walls.

The free edges of said short walls are joined to each other by means of a vertical sheet-metal plate 4 having at least two vertically spaced openings 4*a* and 4*b* which determine communication passages between the discharge duct 2 and the internal space of the storage vessel.

Moreover, the lower end of the vertical duct 2 terminates in a discharge orifice which is separate and distinct from the outlet 5 of the hopper 6 of the storage vessel in accordance with the invention.

Under these conditions, the vertical duct 2 constitutes a discharge device of a type similar to the device described in French Pat. No. 79 28683 filed by the present applicant on Nov. 21st, 1979. It is thus possible to perform emptying of the vessel 1 in two stages. In the first stage, the valve 7 of the outlet 5 of the hopper 6 is left in the closed position while opening only the valve which controls the discharge orifice of the vertical duct 2. The material which fills this duct then escapes immediately, thus making it possible to empty the vessel 1 itself, starting with the upper layers of this latter. In fact, the material located above the level of the opening **4*b* of the vertical discharge duct 2** escapes through this latter in order to flow within said duct and pass downwards to the duct outlet.

When this first vessel-emptying stage has been completed, the valve 7 of the hopper 6 can then be opened in order to discharge the material located below the level of the opening **4*b* of the sheet-metal plate 4**.

In accordance with the invention, provision is made for a duct-clearing carriage which is designated by the general reference numeral 8 and can be displaced over a distance corresponding to the full height of the vertical discharge duct 2. Said carriage is constituted by two vertical sheet-metal members 9 joined together at the upper ends thereof by means of another sheet-metal member 10 which is folded in the shape of a roof. Between the two sheet-metal members 9 are mounted three pulleys 11 over which is passed a control cable 12, one end of which is attached to a fixed point 13 on the storage vessel roof 14 whilst the other end of said cable is wound onto a winch which is driven by a reduction-gear motor 15.

It is worthy of note that the two lengths of the cable 12 as well as the vertical edges of the two vertical sheet-metal members 9 are engaged within two vertical grooves 16 formed in the internal faces of the short walls 3. Said grooves thus serve as guides for the carriage 8 during its displacements within the discharge duct 2.

Said carriage 8 serves as a support for an electric motor 17, the output shaft 18 of which extends vertically above said carriage. In addition, the upper end of said shaft is fitted with one or a number of hooks or rings 19, a chain 20 being attached to each of these latter. The length of each chain corresponds to the radius of the circle 21 inscribed within the interior of the vertical duct 2. The electric motor 17 is supplied with current by means of a conducting cable 22.

Figure 4:
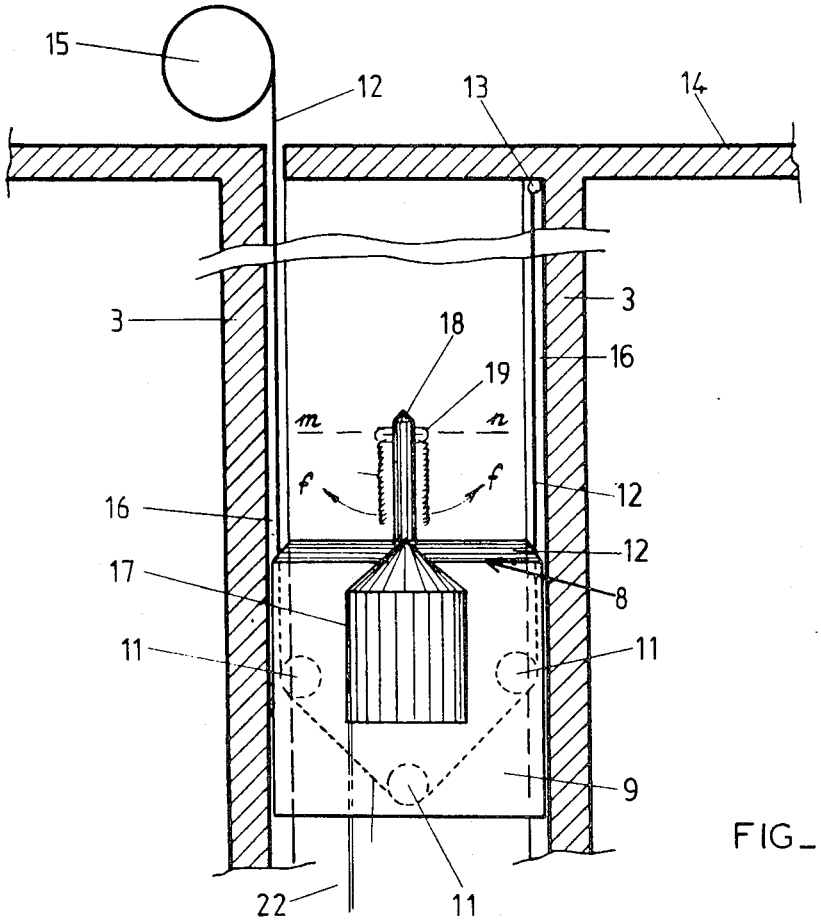
FIG. 4 is a vertical sectional view of FIG. 3.

As can readily be understood, the rotation of the shaft 18 of the motor produces a lifting action on the chains 20 so that these latter move in the direction f up to the level of the horizontal line m-n which passes through the hooks or rings 19 (as shown in FIG. 4). Under these conditions, said chains thus constitute a rotary device which is capable of causing disaggregation or breaking-up of the particles of material contained within the discharge duct 2 in the event of clogging of this latter.

Below the upper level p-q of the hopper 6, said vertical duct is provided at the lower end with an extension 23 which is intended to serve as a housing for the carriage 8 when this latter is not in use. Said carriage is therefore located normally in a standby position within said housing, in readiness for use whenever the need arises.

In a particular embodiment, the lower end of the vertical discharge duct 2 is joined to a passage 24 which extends beneath the hopper 6 so as to terminate in a separate discharge orifice fitted with a shutoff valve 25. In this case, a sliding plate 26 is placed above the housing 23 in order to close this latter when the duct-clearing carriage 8 is not in service. However, it is only necessary to move said plate to its open position **26*a* in order to permit operation of the duct-clearing carriage 8**.

It may be noted that the closure plate 26 is not absolutely essential. In fact, said plate can easily be dispensed with, in which case the stored material also fills the housing 23 and completely surrounds the duct-clearing carriage 8.

In another embodiment, the delivery of material via the discharge duct 2 can take place through the housing 23. In this case, an opening is provided in the bottom of said housing and this latter is normally closed by a shut-off valve 27. It will readily be apparent that, in this embodiment, the stored material fills the housing 23 and completely surrounds the carriage 8. It should also be noted in this instance that the passage 24 is dispensed with and the housing 23 is joined directly to the lower end of the hopper 6 or to the bottom discharge apparatus.

When it is desired to empty the storage vessel in accordance with the invention, the initial operation consists in carrying out a first discharge through the vertical duct 2, this being achieved by operating one of the shutoff valves 25 or 27 as the case may be. As mentioned earlier, this has the effect of discharging the upper layers of material which is stored above the level of the opening **4*b*. If so required, the valve 25 provided at the lower end of the passage 24 could be replaced by a valve placed at the entrance of said passage, that is, at the point of junction of the passage with the lower end of the vertical discharge duct 2**.

In the event of clogging of the discharge duct as a result of agglomeration or agglutination of particles of stored material, said duct can be cleared by means of a very progressive upward displacement of the carriage 8 which is provided for this purpose while at the same time actuating the disaggregating device which is supported by the carriage. It is readily apparent that the movement of upward displacement of said carriage is controlled by means of the reduction-gear motor 15 and of the winch on which the cable 12 is wound. As already mentioned, the rotation of the shaft 18 of the motor produces a lifting action on the chains 20 which accordingly move up to the horizontal plane m-n and then attack the material to be disaggregated. Since this material no longer has any cohesion, it flows freely downwards within the vertical discharge duct. If necessary, windows may be provided in the wall of the passage 24 or in the wall of the housing 23 in order to permit visual observation of the effective outflow of stored material.

As has already been mentioned, the length of the chains 20 is such that these latter sweep the entire surface of the circle 21 which is inscribed within the discharge duct 2. With respect to the full cross-section a-b of said duct, a certain quantity of material may remain in the corners but this is usually of no importance. However, should it be found undesirable to allow any such residual material to remain, provision may in that case be made for chains 20 of greater length equal at least to the half-diagonal of the square or rectangle a-b. In order to disaggregate said residual material, vertical plates can also be provided on the carriage 8; the plates are disposed along the diagonal lines and form virtual knives which are capable of detaching the stored material from the walls of the discharge duct 2.

When said duct has been cleared, which can be checked by observing the appearance of the carriage 8 at the top of the vessel 1, said carriage can be returned downwards into its housing 23 in readiness for a further duct-clearing operation whenever this may prove necessary.

Figure 3:
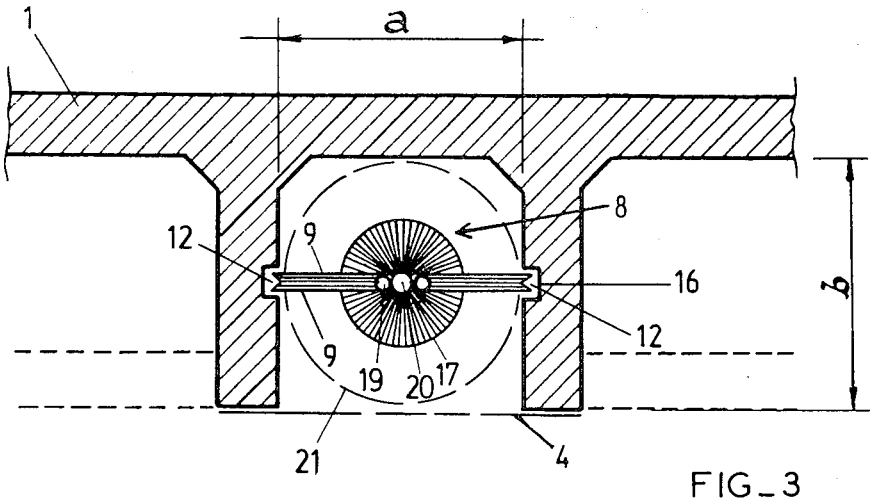
FIG. 3 is a fragmentary horizontal plan view to a different scale and showing only the vertical discharge duct as well as the duct-clearing carriage placed within the interior of the discharge duct.

As can be observed in FIG. 3, the vertical edges of the sheet-metal members 9 of the carriage 8 can be joined together while leaving a passageway for the cable 12. However, these sheet-metal members can also extend to the bottom of the grooves 16; in this case, holes should be bored in the top roof element 10 for the insertion of the two lengths of the cable 12. If necessary, the vertical edges of the sheet-metal members 9 may be fitted with a lining of neoprene or any other suitable material with a view to improving the sliding motion of the carriage within the grooves 16.

It is worthy of note that a single storage vessel 1 can be provided with a plurality of vertical discharge ducts such as the duct 2, in which case each duct is equipped with a duct-clearing carriage 8. If so required, said ducts can be constituted by short vertical walls which are adapted to project outwards instead of walls which project inwards. It will be readily apparent that, in such a case, the storage vessel wall is interrupted at the point corresponding to the spatial interval between the two corresponding short walls in order to be closed at this point by means of a sheet-metal plate 4 provided with openings such as the openings **4*a* and 4*b***. Moreover, the outer edges of the two short external walls are joined to each other by means of a closure wall in order to constitute the corresponding discharge duct.

Figure 6:
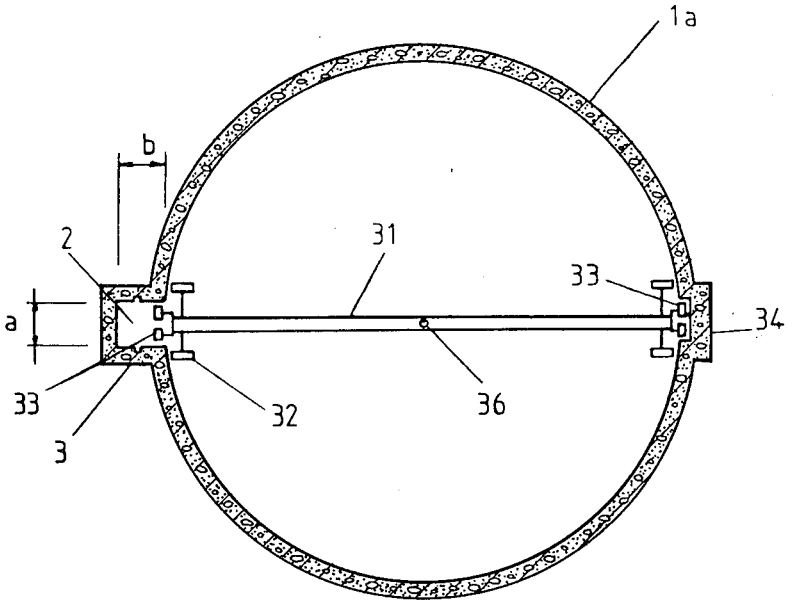
FIGS. 6 and 7 are horizontal sectional views taken respectively along lines VI—VI and VII—VII of FIG. 5.
Figure 5:
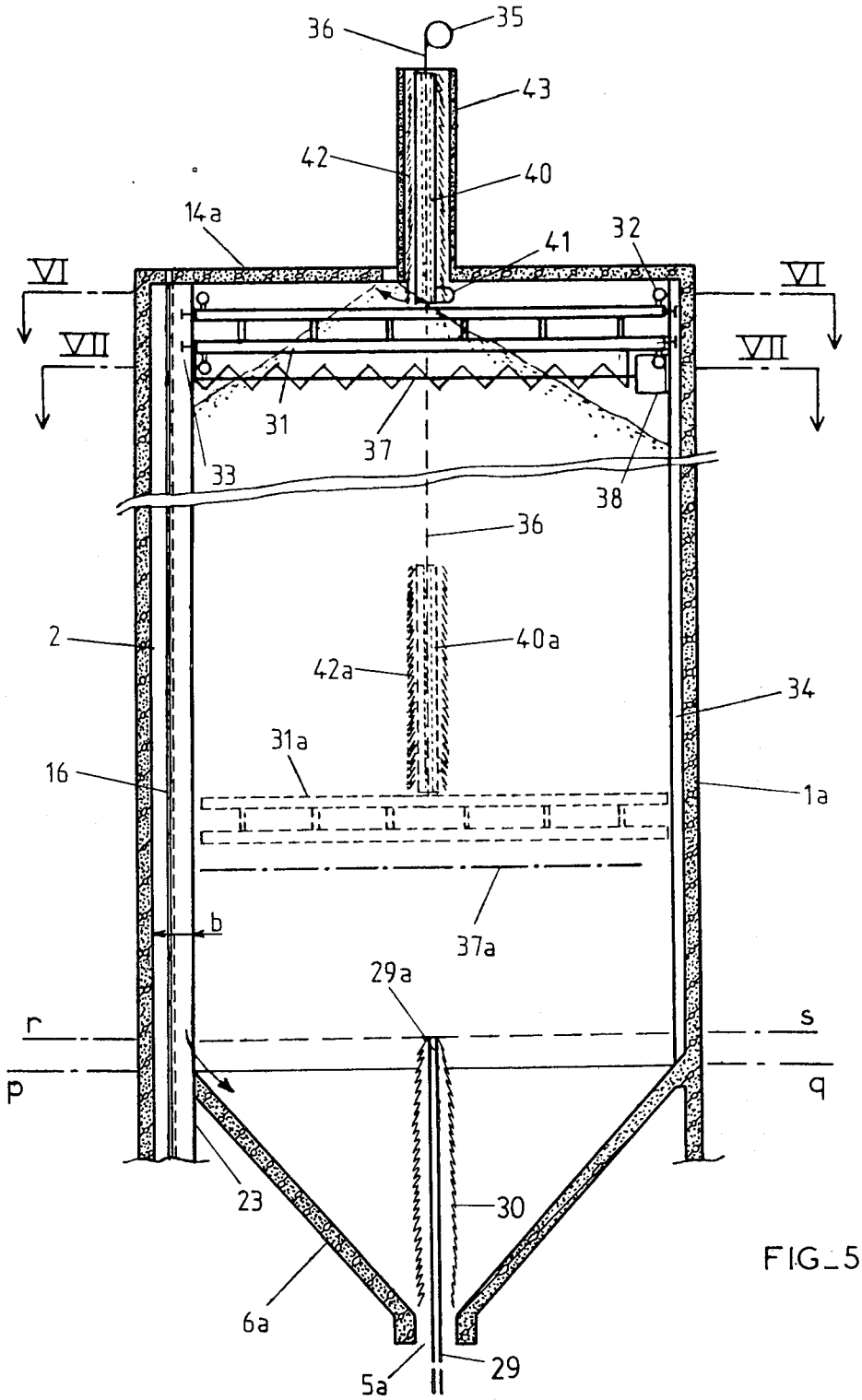
FIG. 5 is a vertical sectional view which is similar to FIG. 1 but shows another embodiment of a storage vessel in accordance with the invention.
Figure 7:
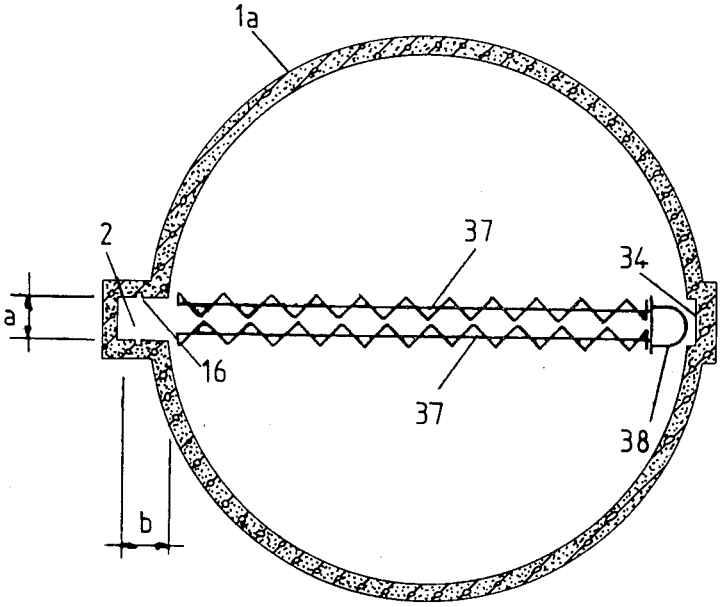

FIGS. 5 to 7 illustrate another embodiment of the storage vessel in accordance with the invention, this vessel being designed for storage of powdered material which presents a very high potential danger of cohesion. As in the preceding case, provision is again made in this embodiment for a vertical discharge duct 2 which encloses a duct-clearing carriage 8. However, since the arrangement is the same as that of the preceding embodiment in this respect, said carriage is not shown in FIGS. 5 to 7. The only difference lies in the fact that this discharge duct is not provided with any sheet-metal dividing wall for isolating the duct from the internal space of the corresponding storage vessel **1*a* and thus for permitting a two-step discharge operation. For this reason, the lower end of said duct opens into the bottom hopper 6*a*** immediately above the top level p-q of said hopper.

However, the essential difference with respect to the preceding embodiment lies in the fact that the vessel **1*a*** under consideration is equipped with two units for the disaggregation of stored material, both units being arranged within the interior of said vessel.

The first unit is stationarily fixed within the hopper **6*a*. This unit consists of a rotating mast 29 which extends within said hopper but the upper end 29*a* of which is located above the level p-q. In addition, the upper end of said mast is adapted to carry one or a number of chains which are capable of upward displacement to the level r-s at the time of rotation of said mast at high speed. Thus, as they are lifted during rotation of the mast 29, said chains accordingly strike the agglomerated particles of stored material, thereby causing disaggregation of this latter. Under these conditions, said material is then permitted to flow through the bottom discharge orifice 5*a* of the hopper 6*a*. As can readily be understood, the mast 29** of this unit is driven in rotation by means of a motor (not shown in the drawings) which is located beneath the discharge hopper.

In regard to the second disaggregating unit provided within the vessel **1*a*, this unit consists of a moving system which is capable of displacement over a range of travel corresponding to the full height of said vessel. This moving system comprises two superposed beams 31, the end of which are fitted with rollers 32 and 33. These two beams extend diametrically within the interior of the vessel 1*a* and the rollers 33 fitted at one end are engaged within the vertical discharge duct 2. In regard to the similar rollers 33 provided at the opposite end, these rollers are engaged within a vertical channel 34 formed in the internal wall of the vessel 1*a* and located in a diametrically opposite position. Thus, these two beams are continuously in the same orientation during the displacements of said moving system in the vertical direction along the wall of the vessel 1*a***.

The displacements just mentioned are controlled by a reduction-gear motor 35 equipped with a winch on which is wound a cable 36, the moving system formed by the two beams 31 being attached to the lower end of said cable.

Figure 9:
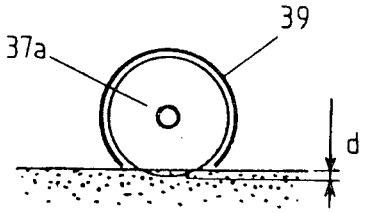
FIGS. 8 and 9 are diagrammatic views in elevation showing two alternative embodiments of the mechanical extraction element which forms part of the disaggregating unit provided in this embodiment.
Figure 8:
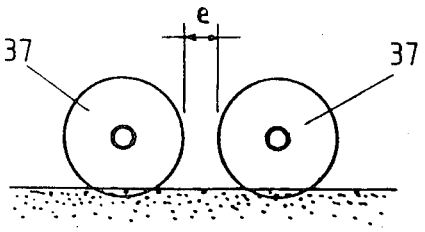

This moving system is so arranged as to carry two endless screws or so-called augers 37 which are suspended from the beams 31 and driven in rotation in opposite directions by a motor 38. As illustrated in FIG. 8, the two augers aforementioned are spaced at a distance e which may or may not be constant. If necessary, said augers can be replaced by a single auger **37*a* fitted with a cover 39 as shown in FIG. 9**, the edges of said cover being so arranged as to permit a depth of penetration d of said auger into the stored material.

The upper end of this movable disaggregating unit is provided with a hollow rotating shaft or mast 40 driven by a motor 41 which is carried by the beams 31, the cable 36 being passed within the interior of said mast 40. One or a number of chains 42 are attached to the upper end of said mast, the length of each chain being such as to correspond substantially to the radius of the storage vessel **1*a***.

When said unit is not in use, it is held in a standby position at the upper end of the storage vessel as shown in FIG. 5. The hollow mast 40 and the chains 42 are then housed within a chimney 43 carried by the top wall **14*a* of the storage vessel. Emptying of said vessel is carried out through the single outlet 5*a* of the hopper 6*a*** under the action of gravity. It is therefore only necessary to open the shutoff valve of said outlet.

If the material does not flow out readily, however, the disaggregating unit provided within the hopper can accordingly be put into operation. The lifting motion of the chains 30 while these latter are being driven in rotation then ensures disaggregation of the material which is present within said hopper and which is thus permitted to flow through the orifice **5*a***.

In the event that the material located above the level r-s should remain in suspension by reason of a process of cohesion of said material, it is only necessary in such a case to actuate the carriage 8 for clearing the vertical discharge duct 2 as well as the movable disaggregating unit which is located in the standby position at the top of the storage vessel **1*a***.

The initial operation consists in upwardly displacing the duct-clearing carriage 8 as described earlier in the embodiment illustrated in FIGS. 1 to 4. This has the effect of forming a free vertical passage over a distance corresponding to the full height of stored material.

The movable disaggregating unit is then put into operation. At the outset, however, only the extracting augers 37 are actuated, thus displacing the material towards the vertical discharge duct 2. The particles which flow through said duct can then pass freely to the hopper 6*a* which has previously been emptied.

When said movable unit has traveled downwards to a sufficient extent, the rotating mast 40 is set in motion, with the result that the chains 42 carried by this latter accordingly strike the particles of stored material and break-up or disaggregate the material which had remained inert on each side of the trench formed by the augers 37. The material which has thus been broken-up then falls into said trench and is discharged by the augers 37 towards the free passage formed within the vertical discharge duct 2.

Should the need arise, said movable disaggregating unit can be displaced downwards over a distance corresponding to the full height of the vessel 1*a*. The unit which is in any case illustrated in FIG. 5 is shown in dashed lines in an intermediate position of downward travel. In this figure, the different components of said unit are designated by the same reference numerals followed by the index a. It will be wholly apparent that this unit is then returned upwards into the top portion of the storage vessel in order to permit further use whenever necessary, after subsequent filling of said vessel.

As can readily be understood, the combined action of the different devices provided in this embodiment is such that a storage vessel can be emptied with complete reliability, even if the vessel contains materials which present a high potential danger of cohesion.

It should be noted that a number of different modifications and alternative embodiments may be contemplated in regard to the devices hereinabove described. Thus in the case of either of the two embodiments described, the chains 20 carried by the rotating shaft 18 of the moving carriage may be replaced by any other rotatable component which is capable of ensuring disaggregation of the material and formation of a free passage within this latter. Likewise in the embodiment shown in FIGS. 5 to 9, the chains 30 carried by the rotating mast 29 and the chains 42 attached to the rotating mast 40 could be replaced by any other rotatable components which are capable of producing disaggregation of the stored material. So far as the endless screws or augers 37 are concerned, they could be replaced by any other mechanical device for extracting the stored material and directing it to the vertical discharge duct.

It is wholly apparent that the interior of the storage vessel shown in FIGS. 1 to 4 can be equipped either with the same disaggregating units as those illustrated in FIGS. 5 to 7 or with only one disaggregating unit.

Figure 10:
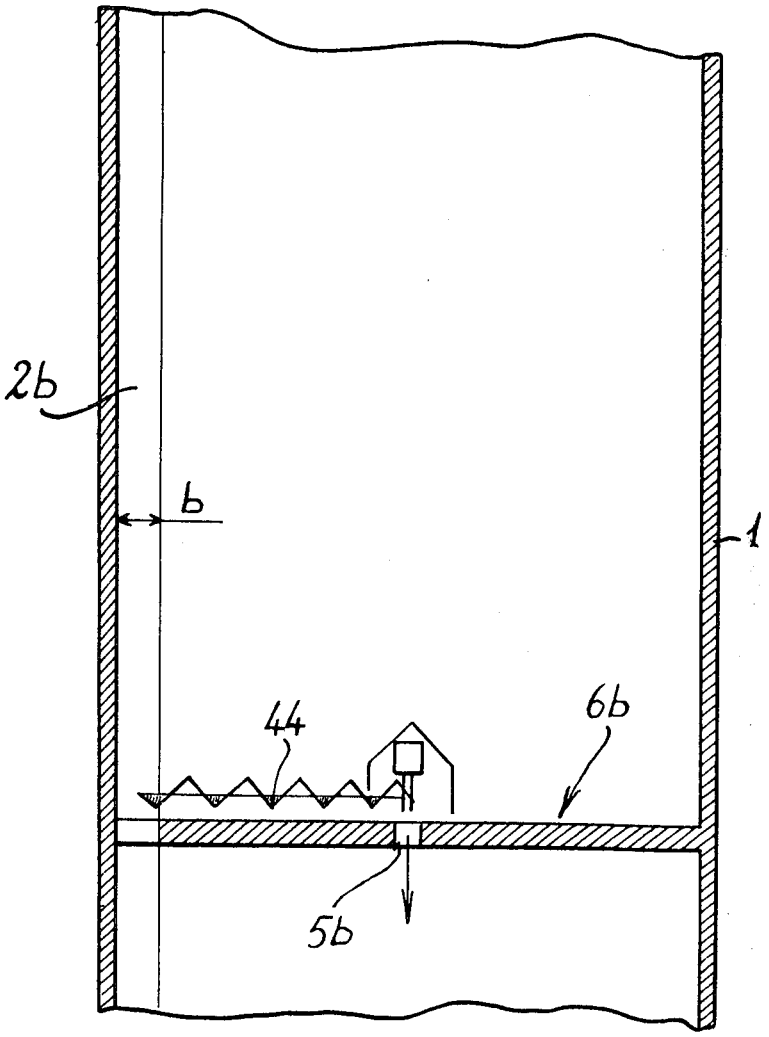
FIG. 10 is a vertical sectional view showing another embodiment of a storage vessel in accordance with the invention.

Moreover, in both of these embodiments, the bottom conical hopper 6 or 6*a* may be replaced by a flat bottom wall 6*b* on condition that a mechanical transfer element is mounted against said bottom wall so as to extend between the lower end of the vertical discharge duct 2*b* and the central discharge orifice 5*b* (see FIG. 10). Said transfer element can advantageously consist of an endless screw or auger 44 rotatably mounted on a vertical pivot located directly opposite to the central discharge orifice 5*b*. When the discharge operation is carried out through the vertical duct 2*b*, said auger is accordingly placed in a position such that its free end is located beneath the outlet orifice of said duct. The auger is then maintained stationary in this position throughout the duration of the discharge operation performed by means of the vertical duct. On completion of this discharge operation, said auger is driven in rotation about the central pivot so as to sweep the entire surface of the bottom wall of the storage vessel.

In the embodiment just described, deflecting plates can advantageously be arranged on each side of the bottom orifice of the vertical discharge duct in order to prevent the material located in the bottom of said vessel from collecting in a caked mass against the lower end of the auger which is thus provided. With a similar object in view, another deflecting plate may be added above the auger and so arranged as to extend over the full length of this latter.

What is claimed is:

1. A vessel for the storage of particulate products in which a vertical discharge duct is provided on the vessel wall, said duct communicating with the interior of said vessel and having at least one discharge opening adjacent its lower end, and a duct-clearing carriage carrying a rotary disaggregating device for dislodging the stored material from the duct, said carriage being mounted for movement over a distance corresponding to the full height of the vertical discharge duct, the lower end of said duct being provided with an extension so arranged as to constitute a housing for said carriage in its out-of-service position.

2. A storage vessel according to claim 1, wherein the rotary disaggregating device provided on the duct-clearing carriage consists of at least one chain attached to the upper end of the vertical rotating shaft of a motor supported by said carriage.

3. A storage vessel according to claim 1 wherein the side walls of the vertical discharge duct are provided with vertical grooves in which the corresponding edges of the duct-clearing carriage are engaged so as to guide the movements of travel of said carriage, said movements of travel being controlled by a cable actuated by means of a reduction-gear motor.

4. A storage vessel according to claim 1, wherein said vessel contains a movable disaggregating unit comprising on the one hand at least one movable disaggregating device and on the other hand at least one mechanical extraction element which is capable of transferring the disaggregated material to the vertical discharge duct provided on the internal wall of said vessel.

5. A storage vessel according to claim 4, wherein the movable disaggregating unit comprises a frame constituted by at least one horizontal beam disposed along that diameter of said vessel which passes through the vertical discharge duct, the ends of said at least one beam being fitted with rollers engaged respectively within said discharge duct and within a vertical channel formed in the internal wall of the storage vessel in a diametrically opposite direction.

6. A storage vessel according to claim 5, wherein the mechanical extraction element of the movable disaggregating unit consists of at least one auger suspended from the frame of said unit whilst the rotary disaggregating device consists of at least one chain attached to a vertical shaft which is driven in rotation.

7. A storage vessel according to claim 1 wherein, in the case of a vessel having a flat bottom wall, a mechanical transfer element is provided between the lower end of the discharge duct and a discharge orifice provided at the center of said bottom wall, said transfer element being mounted on a pivot located directly opposite to said orifice and rotatably driven so as to sweep the bottom wall of the vessel after completion of the discharge operation performed through the vertical duct.

8. A storage vessel according to claim 1, wherein said duct communicates with the interior of said vessel along its entire length.

9. A storage vessel according to claim 1, wherein said duct communicates with the interior of said vessel only through a plurality of openings spaced at intervals along said vessel wall.

10. A storage vessel according to claim 1, wherein said duct terminates downwardly in a discharge orifice at the lower end of said extension, and means selectively to open and close said discharge orifice.

11. A storage vessel according to claim 1, and a discharge passage that diverges downwardly from said extension adjacent the lower end of said discharge duct and that terminates downwardly in a discharge orifice, and means selectively to open and close said discharge orifice.

12. A storage vessel according to claim 11, said vessel terminating downwardly in an outlet disposed adjacent said orifice, and a separate valve for said outlet.

* * * * *